United States Patent [19]

Scott

[11] 4,123,885

[45] Nov. 7, 1978

[54] BUILDING PANEL JOINT

[75] Inventor: Harley D. Scott, Wexford, Pa.

[73] Assignee: Cyclops Corporation, Pittsburgh, Pa.

[21] Appl. No.: 682,156

[22] Filed: Apr. 30, 1976

[51] Int. Cl.[2] ..... E04B 5/52

[52] U.S. Cl. ..... 52/483; 52/802

[58] Field of Search ..... 52/619, 483, 592, 403, 52/595, 489

[56] References Cited

U.S. PATENT DOCUMENTS

| | | | |
|---|---|---|---|
| 3,667,180 | 6/1972 | Tischuk | 52/595 X |
| 3,714,747 | 2/1973 | Curran | 52/595 X |
| 3,777,430 | 12/1973 | Tischuk | 52/483 X |
| 3,797,190 | 3/1974 | Widdowson | 52/619 X |
| 3,849,959 | 11/1974 | Lindner | 52/403 |

*Primary Examiner*—Price C. Faw, Jr.
*Assistant Examiner*—Carl D. Friedman
*Attorney, Agent, or Firm*—William J. Ruano

[57] ABSTRACT

A building construction panel of the type having exterior and interior metal skins enclosing a foam core and having, at their edges, mating elements for sealing the panels in edge-to-edge relationship. The improvement relates to a sealing construction that insures maintenance of the seal irrespective of wide variations in the gap between adjoining attached panels. Also the core is maintained encapsulated by a plastic sheet which is uniquely connected to the edges of the outer and inner metal skins.

7 Claims, 11 Drawing Figures

BUILDING PANEL JOINT

This invention relates to a building panel of the type having outer and inner metal skins enclosing a foam core and, more particularly, relates to joints for securing like panels in edge-to-edge relationship by mating elements.

An outstanding disadvantage of building panels of this type which have been used in the past is that when like panels are attached together in lateral sealing relationship, the seal tends to be broken as the result of an abnormal gap that may occur between attached panels as a consequence of tolerance variations, misalignment of the building structure, and contraction of the metallic skins as the result of very low ambient temperatures.

An object of the present invention is to provide a novel building panel construction and end joint which overcome the abovenamed disadvantages and which will maintain a perfect seal between the mating elements of adjoining like panels even when the gap therebetween become excessively large.

Another object of the present invention is to provide complete encapsulation of the foam core, irrespective of wide variations in the gap between adjoining attached panels.

Still another object of the present invention is to provide a sealing assembly including a sealing reservoir that will maintain the seal between the detachably secured panels irrespective of wide variations within limits from a metal-to-metal contact between adjoining outer and inner metallic skins of adjoining panels to very wide gaps therebetween.

Other objects and advantages will become more apparent from a study of the following description taken with the accompanying drawings wherein.

Figure 4:
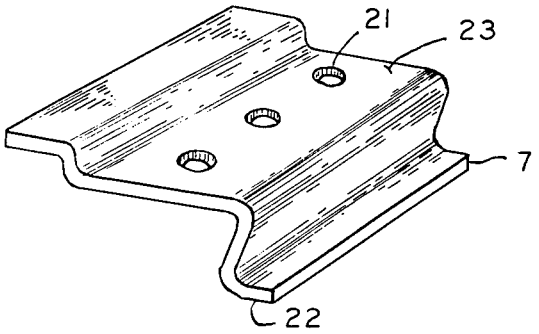
FIG. 4 is an enlarged, top, perspective view of the panel clip 7 shown in FIG. 1.
Figure 5:
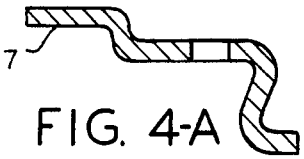
Figure 5:
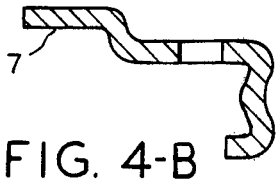
Figure 5:
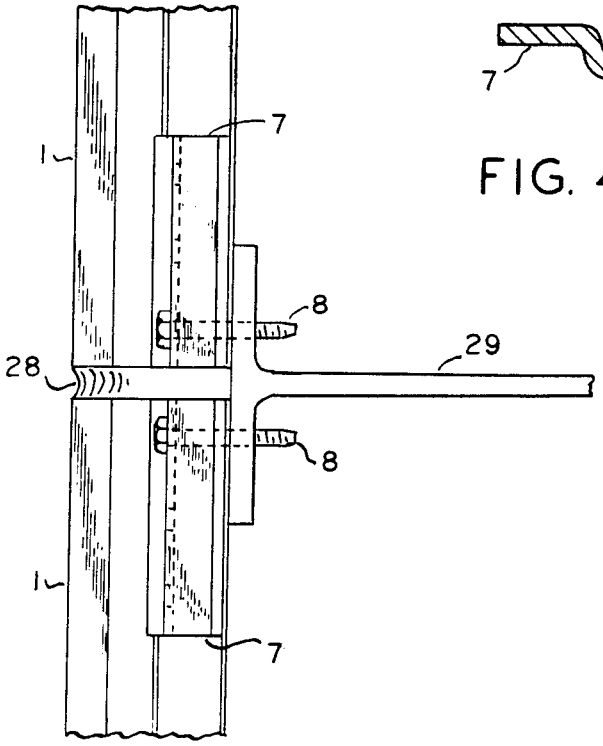

FIG. 4-A is a vertical, cross-sectional view of the clip illustrated in FIG. 4 showing a substantially Z-shaped support;

FIG. 4-B is a view similar to FIG. 4-A of a modification showing a sigma shaped support;

FIG. 5 shows attached ends of like panels when the end joint occurs at a girt 29 having a narrow flange or mounting surface.

Figure 1:
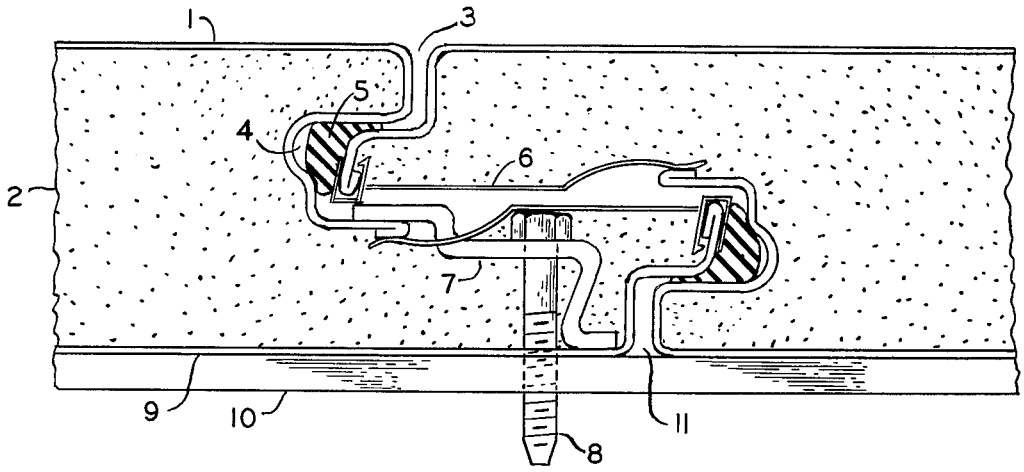
FIG. 1 is a vertical, cross-sectional view of the joint between a pair of like metal skinned foam core panels embodying the principles of my invention and showing an intermediate size gap therebetween and FIG. 1-A is an enlarged, exploded view of parts of FIG. 1.
Figure 6:
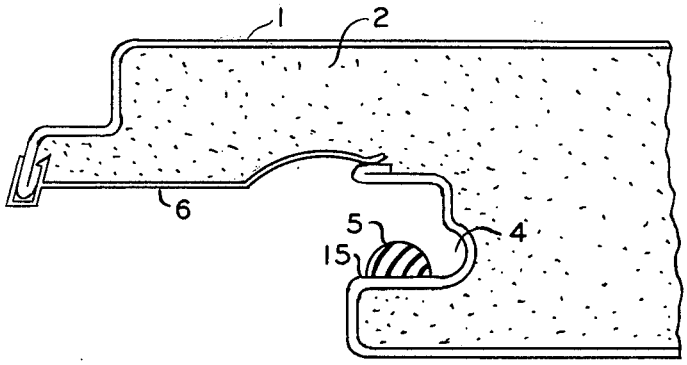
Figure 7:
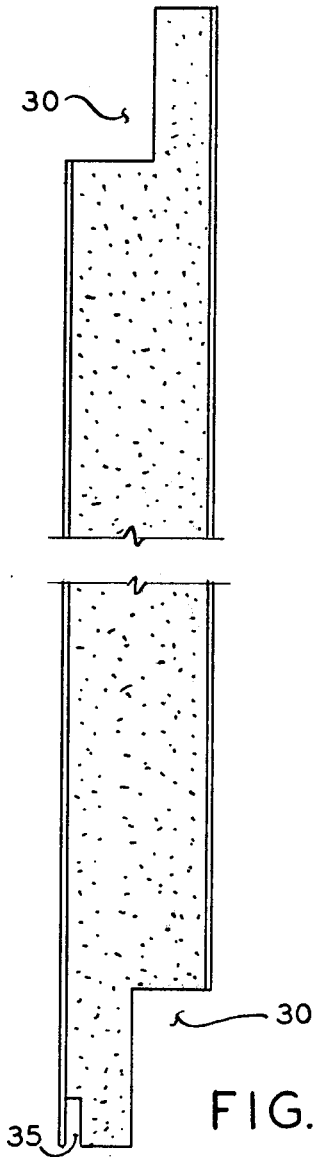

FIG. 6 shows one of the panels of FIG. 1 as it comes from the factory;

FIG. 7 shows a vertical cross section of an end joint panel; and

Figure 8:
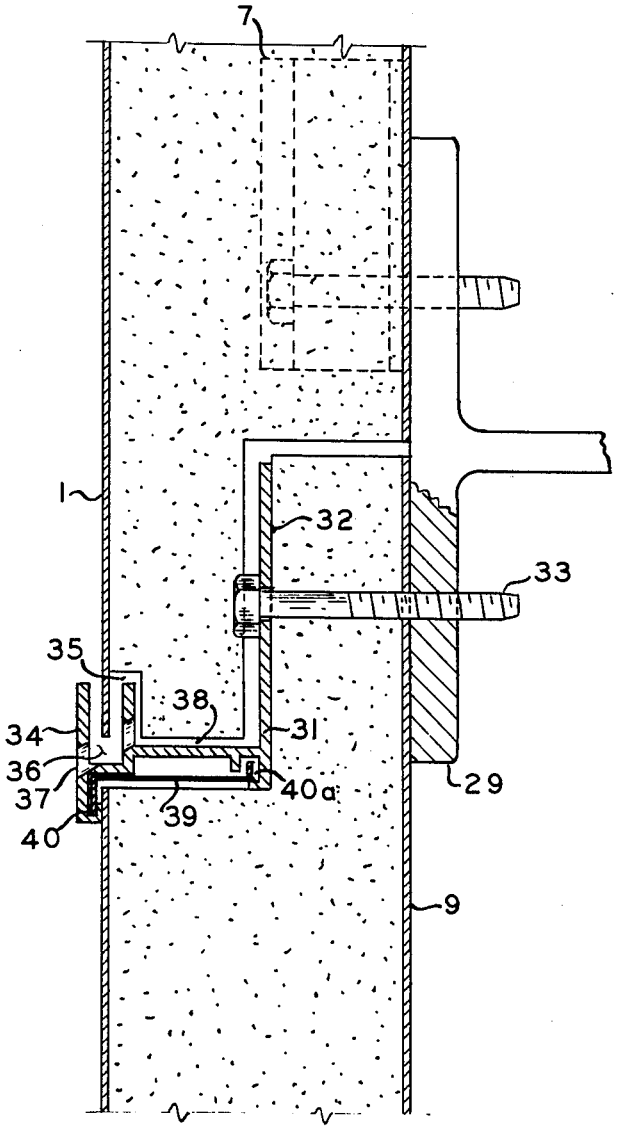

FIG. 8 shows a modification of the end joint panel embodying the present invention.

Referring more particularly to FIG. 1 and FIG. 1-A of the drawings, numeral 1 denotes an exterior metal skin of steel, aluminum or other suitable metal which partially surrounds and is bonded to a core 2 of plastic foam material such as polyurethane and numeral 3 denotes a spacing or gap between such metal skins of like panels. Likewise numeral 9 denotes an interior metal skin of the panel. A pair of like panels are shown attached together in interlocking relationship by a pair of joints formed by mating portions as shown in FIG. 1. It will be understood that the panel shown at the left of the joint 3 will have a left end construction identical to the left end of the panel shown to the right of the gap 3. A multiplicity of like panels may be attached together side by side to form a wall of a building, each having exterior metal skins laterally offset from the interior skins.

The outer metal skin 1 is reversely bent so as to form a reservoir 4 as well as a female element for receiving the male element of the panel shown at the right of gap 3. The reservoir 4 forms a large pocket for receiving sealant 5, being sufficiently sized to maintain a greater aspect ratio, thus retaining resiliency for longer life. The size of the sealant pocket and sealant are such as to not to reduce the sealant to extremely thin portions, even when the gap between the adjoining panels becomes extremely small as shown by gap 3*a* in FIG. 2 since the solvents would otherwise evaporate and the sealant would become dried out and ineffective.

Figure 2:
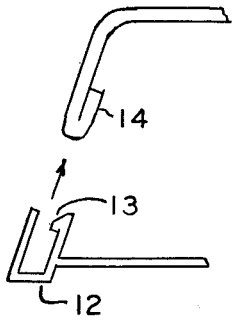
FIG. 2 is a view similar to FIG. 1 except showing the longitudinally offset sides of the panels in contacting relationship with no gap therebetween.
Figure 2:
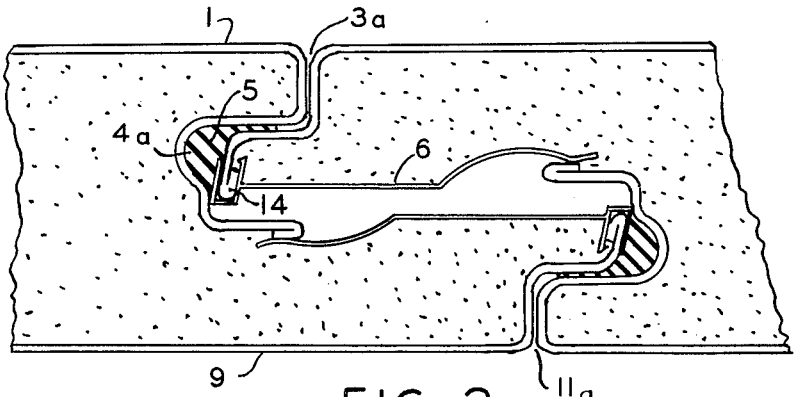
Figure 3:
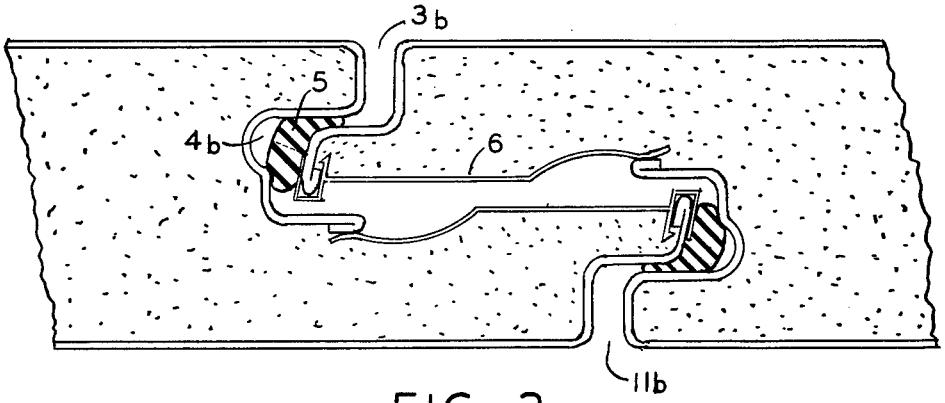
FIG. 3 is a view similar to FIG. 1 except showing a wide gap between adjoining panels.

Thus the larger cavity (4*a* and 4*b*) for the sealant 5 assures adequate proportions to properly seal the joint whether the gap 3*a* is closed tightly, as shown in FIG. 2, or whether the joint is held open with a large gap 3*b*, as shown in FIG. 3, respectively. The reservoir allows lateral room for the sealant to flow when the joint is closed tightly, as shown in FIG. 2.

FIG. 6 shows that the sealant is factory applied on the returned flange, 15, just outside of the reservoir area, 4. Then when two panels are engaged, the sealant will be forced to move in the direction of the reservoir. If the joint is wide, the sealant will not enter the reservoir 4*b* (FIG. 3). If the joint is in the normal position (FIG. 1) the sealant will only partially enter the reservoir. A completely closed joint, as in FIG. 2, will cause the sealant to move into and entirely fill the reservoir 4*a*. The advantage here is that provision has been made for a complete seal in any of the three positions, but none of the positions squeezes the sealant out of the joint. There is always intimate contact of all metal skins with the sealant; and even in the worst condition, (FIG. 2) there is maintained the correct aspect ratio, i.e., width to height, of the sealant bead.

The reservoir for the sealant allows greater room for adjustment when the gap must be adjusted to compensate for manufacturing tolerances and for misalignment of the building structure. The proper location of the sealant makes provision for movement due to thermal expansion and contraction over the width of each panel.

The extreme ends of the outer metal skin 1 and inner metal skin 9 are sharply reversely bent to form a hem, such as 14 shown in FIGS. 1 and 1-A. The hemmed edges of the metal skins allow for coil width variation as the metal coils are received from the rolling mills. Standard mill tolerances can be absorbed to assure precise positioning of the finished edges. The hemming also stiffens the edges, providing greater holding strength for the retaining clips 7, which will be described. Also, hem 14 shown at the left of FIG. 2 forms an obtuse angle with a horizontal plane which will wipe the sealant into the space provided in the reservoir, rather than squeeze it outwardly toward gap 3*a* where it would be thinned out and thus become ineffective as a sealant.

In order to fully encapsulate the core 2, a plastic sheet or edge closure 6 is provided for bridging the gap between the hemmed edges 14 of each panel. A unique attachment means, as shown more clearly in FIG. 1-A, is provided in the form of a somewhat U-shaped extruded plastic edge having a bulb or projection 13 which will spread out laterally when moved in the direction of the arrow and then contract and lock against the extremity of the hemmed edge 14 as a stop, as illustrated in FIG. 1, to hold one edge of the plastic sheet on metal skin 1. The other edge portion of plastic sheet 6 will ride on the hemmed edge of the interior metal skin 9 of the adjoining panel, as shown in FIG. 1. A similar closure or plastic sheet is provided between the bottom hemmed edges. Such construction will insure that the core 2 will be completely encapsulated so as to prevent entrance of moisture, etc. irrespective of the size of the gap between adjoining, attached panels.

FIG. 4 more clearly shows the shape of the unique clip 7, shown in FIG. 1, having a land offset 23 to provide for head clearance of the fastener screw 8 when the two panels are detachably secured together and fastened to a structural girt 10 as shown in FIG. 1. The threaded portion of fastener 8 threadedly engages the girt 10 to firmly secure both panels thereto in end-to-end relationship.

The clip 7 may have either a substantially Z-shaped support portion 22, as shown in FIGS. 4 and 4-A, or may have a sigma shaped support as shown in FIG. 4-B which provides somewhat greater columnar strength in cold formed steel. The clip is provided with a plurality of holes 21, for example, three holes, thereby permitting it to be used at either end of the panels, especially when an end joint occurs at a girt 29 having a narrow flange or mounting surface, as shown in FIG. 5. The upper and lower panels meet at horizontal joint 28 and two clips 7,7 are located in close proximity, thereby necessitating either "right hand" and "left had" clips or the use of the same clip with holes at both ends, permitting the identical clip to be located at the upper and lower panels. The center hole can be used at girts other than at the end joint.

The clip 7 has a broad bearing surface at the base of the substantially Z or sigma shaped leg to more easily distribute the stresses resulting from negative wind load conditions. This eliminates the tendency to tear the metal skins, which can result when cut edges bear on the inside of the metal skins as occurs in constructions used in the past.

The present state of the art favors square cut ends, which are then fitted into an extrusion having essentially an "H" shape. The major disadvantages of this system are: 1. Aesthetically the broad surface of the extrusion is objectional, as it looks like a batten; 2. the extrusion allows through-wall conductance; that is, the cold outside temperature will travel through the batten web into the warm interior surface, permitting condensation and frost build-up.

Another system requires prefabrication of the ends, whereby the exterior skin is returned 90°. The two panels are butted together allowing a gap of about ¼ inch, which is then filled with caulking (FIG. 5). This is more expensive fabrication; but the end results do provide a narrow joint. However, the job conditions and skill of the workman are critical factors; and all too frequently the joints are irregular and do not present a pleasing appearance.

FIGS. 7 and 8 show an end joint design embodying the present invention.

The ends of the panels are factory cut to a special configuration, which provides for a ship-lap type of joint 30. A continuous extrusion 31, is provided in lengths which are some multiple of the width of the panel. The extrusion fits into the ship-lap cut 30 of the lower panel so as to bear on the exposed foam core 32, and completely cover the cut portion. The proportions of the bearing surface are such that wind loads on the panels will be evenly distributed by the extrusion, which then serves as a mounting clip to support the top of the lower panel. Self-tapping screw 33, penetrates the extrusion 31, the foam core, and inner metal skin 9, and is secured into the girt 29, to support the top of the lower panel.

The extrusion 31, is deliberately designed to not penetrate through the entire depth of the panel, thereby effectively eliminating through-wall conductivity, which is one of the major objections of the present system.

The outermost surface 34, of the extrusion 31, is of a rather small and inconspicuous proportion so as to eliminate the objectional batten appearance of the earlier joint systems. The same surface can be painted to match the exterior of the wall panels.

The bottom ends of the second course of panels are cut similar to the top of the lower panels. This end is supported by means of the clip 7 previously described. A minor variation on the ship-lap cut on this end is the pocket 35, immediately inside of the exterior skin. As the panel is placed into position, the exterior skin 1, is fitted into the U-shaped slot 36, in the extrusion 31. Weep holes 37 are predrilled through both vertical legs of the U-shaped slot 36. Rain water cascading down over the face of the panels will enter the U-shaped slot 36, and immediately be conducted out through the outer weep holes 37. Water entering the vertical joint 3, will flow down into the interior wide U-shaped slot 38, and be conducted out through the inner and outer weep holes 37. The outer U-channel 36, is located so as to have the bottom surface somewhat lower than the bottom of the inner channel 38, thereby preventing a reverse flow of the water.

The extrusion will be supplied in convenient lengths, but provision for thermal expansion must be provided in the form of a predetermined gap between the ends of adjacent members. To prevent water infiltration of this gap, a preformed butt strip 39, is supplied, designed to slip into twin slots 40 and **40*a*** on the underside of the extrusion.

Thus it will be seen that I have provided an efficient and reliable joint construction for a foam type, double metal skin building panel, which joint will maintain a perfect seal irrespective of wide variations in the gap between adjoining like panels that are fastened together; also, I have provided an encapsulating plastic sheet which is held in place by a unique locking joint to ensure complete encapsulation of the core irrespective of wide variations in the gap between adjoining, interconnected like panels.

While I have illustrated and described several embodiments of my invention, it will be understood that these are by way of illustration only and that various changes and modifications may be contemplated in my invention and within the scope of the following claims.

I claim:

1. In a wall structure comprising a pair of vertically extending panels having ends secured together by fastening them to flanges of a side girt, the panels being of the type having a foam core bonded to exterior and interior metal skins which are vertically offset and spaced apart by said foam core; the improvement in the end joint between said panels comprising a clip having an upper land engaging the extremity of the exterior metal skin of each panel and having an intermediate land with at least one hole through which a fastener screw extends and which is screwed into the supporting girt, the support portion of said clip being laterally bent to provide a large surface area of support on the interior metal skin and girt.

2. The improvement recited in claim 1 wherein said support portion of said clip is substantially Z shaped.

3. The improvement recited in claim 1 wherein said support portion of said clip is substantially sigma shaped.

4. The improvement recited in claim 1 wherein a plurality of holes are provided in said intermediate land.

5. The improvement recited in claim 1 wherein adjoining foam cores have a ship-lap joint, a generally L-shaped extrusion having a vertical leg covering the vertically extending surface of an interlocking element of said foam core and having a horizontal leg covering the bottom end of the other interlocking element of the foam core, a self-tapping screw extending through said first mentioned interlocking element and into said side girt.

6. The improvement recited in claim 5 wherein said horizontal leg terminates in a U-shaped channel having one leg projecting into a slot of the core in the upper interlocking element and the other leg extending vertically outside the panels and bridging the outer skins of said panels, and drainage holes extending through the bottom portions of said legs.

7. For use in a wall structure comprising a plurality of panels interlocked in side-by-side relationship for mounting on girts of a structural framework, the panels being of the type having a foam core bonded to exterior and interior metal skins which are laterally offset and spaced apart; the improvement in the interlocking sides of the adjacent panels comprising reversely bent female portions of exterior and interior metal skins of adjacent panels formed in said core, each including a bulbous reservoir portion of greater depth laterally than the female portion, a relatively large body of sealant deposited on one side of each of said reversely bent female portions just outside said bulbous reservoir portions, the other exterior and interior metal skins of adjacent panels being shaped to form male portions for insertion into said female portions but being blunt as compared to said bulbous portions to prevent substantial nesting therewith so that upon insertion of said male portions into said female portions, the former will wipe said bodies of sealant from said sides of the reversely bent female portions and force them only into said female portions but not in the bulbous portions to form a weather-tight seal between said exterior and interior metal skins even when they are at a substantially gap distance apart, and which will force a portion of said bodies of sealant into said bulbous portions when there is no gap or only a very small gap between said exterior and interior metal skins to retain said weather-tight seal therebetween the extremities of said male elements being sharply reversely bent and being a substantial distance apart, together with a plastic sheet bridging the extremities of said male and female portions of the metal skins of each panel to completely encapsulate the core of the panel, one edge of each plastic sheet having a U-shaped portion which slip fits onto said sharply reversely bent extremity of the male shaped exterior and interior skins of adjoining panels, there being an inward projection on one of the extremities of the U-shaped portion to serve as a stop which engages the extremities of said skins to lock said plastic sheets in place.

* * * * *